US006450842B1

(12) United States Patent
Matsuda et al.

(10) Patent No.: US 6,450,842 B1
(45) Date of Patent: Sep. 17, 2002

(54) TERMINAL CONNECTOR AND METHOD OF FABRICATION

(75) Inventors: Takeshi Matsuda; Nobuyuki Mano, both of Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 09/680,090

(22) Filed: Oct. 5, 2000

(30) Foreign Application Priority Data

Oct. 5, 1999 (JP) ..... 11-284913

(51) Int. Cl.[7] ..... H01R 4/30; H01R 4/38; H01R 13/405; H01R 11/20; H01R 4/24

(52) U.S. Cl. ..... 439/801; 439/736; 439/431

(58) Field of Search ..... 439/736, 801, 439/431

(56) References Cited

U.S. PATENT DOCUMENTS 4,360,245 A * 11/1982 Nikitas ..... 339/218
4,457,573 A * 7/1984 Bailey et al. ..... 339/128
4,461,925 A * 7/1984 Bowsky et al. ..... 174/152
4,480,151 A * 10/1984 Dozier ..... 174/153
5,046,243 A * 9/1991 Walker ..... 29/878
5,487,685 A * 1/1996 Stillback et al. ..... 439/801
5,664,971 A 9/1997 Coy ..... 439/811
5,836,792 A * 11/1998 Thumma et al. ..... 439/736
6,015,316 A * 1/2000 Matsubara ..... 439/736

FOREIGN PATENT DOCUMENTS

JP 09055268 2/1997

* cited by examiner

*Primary Examiner*—P. Austin Bradley
*Assistant Examiner*—Edwin A. León
(74) *Attorney, Agent, or Firm*—Darby & Darby

(57) ABSTRACT

A forged terminal body receives a resin knob assembled without pre-positioning. Anti-slip projections on the terminal body penetrate the knob during assembly to resist torque during connection. The anti-slip projections have asymmetric triangular cross sections with a steeper side of the triangle facing in the tightening direction. In one embodiment of the invention, the anti-slip projections are prismatic projections radially arranged on a collar. In a second embodiment of the invention, the anti-slip projections extend from the collar along a terminal body upon which the resin knob is press fitted.

12 Claims, 6 Drawing Sheets

TERMINAL CONNECTOR AND METHOD OF FABRICATION

BACKGROUND OF THE INVENTION

1. Field of the Invention

The present invention relates to a terminal connector used in electrical systems, particularly in audio and video equipment systems. The present invention also relates to a method of fabricating the terminal connector.

2. Description of the Related Art

Referring to FIG. 5, a conventional terminal connector, shown generally at 100', includes an electrically conductive terminal plate 14 mounted on an insulative circuit board 10. A terminal 15 is secured to insulative circuit board 10 by a screw portion 17 threaded through a screw hole 16 in terminal plate 14. A knob 19, affixed projecting away from terminal 15 enables screwing and unscrewing of screw portion 17 for making electrical connection, as will be explained.

A cylindrical portion 11, surrounding a part of terminal 15 near a first surface of insulative circuit board 10 and helps avoid lead wire shorts and reduces the chance of electrical contact with a person or an object. Knob 19 of terminal 15 also protrudes away from the first surface. Cylindrical portion 11 has at least one lead wire insertion notch 12 in its outer periphery.

A through hole 13 accommodates adjustable screw portion 17 of terminal 15. Screw portion 17 is centered in cylindrical portion 11. Around through hole 13 a plurality of insertion holes 20 permit insertion of one or more press-in lock pieces 21 and a terminal portion 22 of terminal plate 14 into selected insertion holes 20 to fix terminal plate 14 firmly to insulative circuit board 10.

Referring now also to FIG. 6, terminal body 59' made from electrically conductive material. Terminal body 59' has a cylindrical plug connection portion 23, suitable for accepting the insertion of a conventional banana tip, a wire end, or other conductor. A collar 18 is pulled down into stabilizing contact with insulative circuit board 10 when screw portion 17 is tightened. The rim of collar 18 is partially removed to form a pair of anti-slip flats 28 for preventing rotation of terminal body 59' with respect to covering knob 19.

Terminal body 59' is conventionally formed by cold forging, i.e. compressing a metal material between dies at temperatures not higher than the material's recrystallization temperature. Through cold forging, conventional cylindrical plug connection portion 23, collar 18, and screw portion 17 are simultaneously formed. Screw portion 17 and flats 28 are not readily formed by cold forging, and are therefore conventionally machined in a subsequent step.

Referring to FIG. 5, knob 19 is generally cylindrical in shape. A fit hole 25, shaped to receive plug connection portion 23, passes through the center of knob 19. A plug insertion opening 26, having a diameter greater than that of fit hole 25, is formed at the top of fit hole 25. A non-circular collar fit-in recess 24 at the bottom of fit hole 25 engages collar 18, including flats 28.

During assembly, plug connection portion 23 of terminal 15 is inserted into fit hole 25 from below. Then, collar 18 is fitted into collar fit-in recess 24. The top of plug connection portion 23 is deformed outward, by swaging or other process, to create a bent portion 27. Thus, terminal body 59 is engaged and integrally fixed in knob 19 by bent portion 27 and collar 18.

When screw portion 17, of terminal 15, is tightened in screw hole 16 in terminal plate 14, a bottom surface of collar 18 and the top surface of terminal plate 14 sandwich a lead wire (not shown) for electric contact. A banana plug (not shown) may be inserted in plug connection portion 23 of terminal 15 for electric connection. More than one lead wire may be captured in this way, and connected to a conductor inserted into plug connection portion 23 and/or terminal portion 22.

Conventional terminal connectors have had several problems, particularly concerning the configuration and the fabrication method of terminal body 59'.

Conventional terminal body 59', cannot be fabricated in a single step of cold forging. Therefore, removing part of the above-described collar 18 to form flats 28 requires an additional step. This increases manufacturing cost.

Fabrication by cold forging has advantages including, no waste chip production, exact dimensions, and higher product strength. However, since cold forging is a difficult fabrication method, cold forging can be used to fabricate the terminal body 59' only in limited production facilities. Accordingly, when fabrication by cold forging is employed, is desirable that the entire terminal body 59' be formed in a single step to limit transportation costs.

Assembly of conventional terminal body 59', requires collar 18 to be positioned individually in collar fit-in recesses 24. Since collar fit-in recess 24 and corresponding collar 18 with flats 28 both have non-circular shapes, assembly must proceed slowly.

In addition, assembly of conventional terminal body 59' and knob 19 cannot be carried out by automatic assembly machine because of the additional individual positioning that is required. As a consequence, increased man-hours are required for assembly.

Incorrect assembly positioning may cause deformation of the peripheries of collar fit-in recesses 24 and corresponding insufficient anti-slip function during assembly. Such deformations may result in unacceptably high rejection rates, with consequent cost increases.

As discussed above, the conventional fabrication steps of terminal body 59' and later assembly with knob 19 require expensive labor and effort thus increasing fabrication costs and increasing anti-slip failures.

OBJECTS AND SUMMARY OF THE INVENTION

It is an object of the present invention to provide a terminal connector providing an anti-slip function.

It is a further object of the present invention to provide a terminal connector with simple construction.

It is a further object of the present invention to provide a method of single-step fabrication for a terminal body.

It is a further object of the present invention to provide a method of assembling a terminal and allowing anti-slip function without pre-positioning the terminal body.

The present invention relates to a forged terminal body and a resin knob assembled without pre-positioning. Anti-slip projections on the terminal body penetrate the knob during assembly to resist torque during connection. The anti-slip projections have asymmetric triangular cross sections with a steeper side of the triangle facing in the tightening direction. In one embodiment of the invention, the anti-slip projections are prismatic projections radially arranged on a collar. In a second embodiment of the invention, the anti-slip projections extend from the collar along a terminal body upon which the resin knob is press fitted.

According to an embodiment of the invention there is provided a terminal connector comprising: a circuit board, a terminal plate attached to the circuit board, a terminal threadable to the terminal plate allowing adjustment relative to the circuit board, the terminal being a terminal body and a knob covering part of the terminal body, the terminal body with a plug connection portion opposite a screw portion, the terminal body also containing a collar and at least one anti-slip projection, the knob having a fit hole and a collar fit-in recess; the plug connection portion in the fit hole and the collar in the collar fit-in recess engaging the anti-slip projection in the knob.

According to an another embodiment of the invention there is provided a terminal connector further comprising: at least one anti-slip projection having an acute profile arranged radially on the collar on the first side of the collar.

According to another embodiment of the invention there is provided a terminal connector further comprising: at least one anti-slip projection having an acute profile arranged radially on the plug connection portion, along a long axis of the plug connection portion, and anti-slip projections arranged on the boarder between the plug connection portion and the first side of the collar.

According to another embodiment of the invention there is provided a terminal connector further comprising: a rim of the plug connection portion opposite the first side of the collar formed in a bent portion to attach to the fit hole.

According to another embodiment of the invention there is provided a method of fabricating a terminal connector, the method comprising the steps of: forming a terminal body, forming a knob containing a plug insertion opening a fit hole and a collar fit-in recess opposite the plug insertion opening, fitting the terminal body into the knob so that at least one anti-slip projection engages with the knob to form a terminal, and engaging the terminal with a terminal plate attached to an insulative circuit board, so as to be adjustable.

According to another embodiment of the present invention there is provided a method of fabricating a terminal connector further comprising: a plug connection portion opposite a end screw portion, a disk-like collar between the plug connection portion and the screw portion, and at least one anti-slip projection on a first side of the collar on the plug-connection-portion side of the collar.

According to the present invention, a terminal connector and a method of fabricating the same are provided in which a terminal body can be fabricated in a single step and the terminal body and a knob can be assembled without positioning, while offering an anti-slip function as well.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
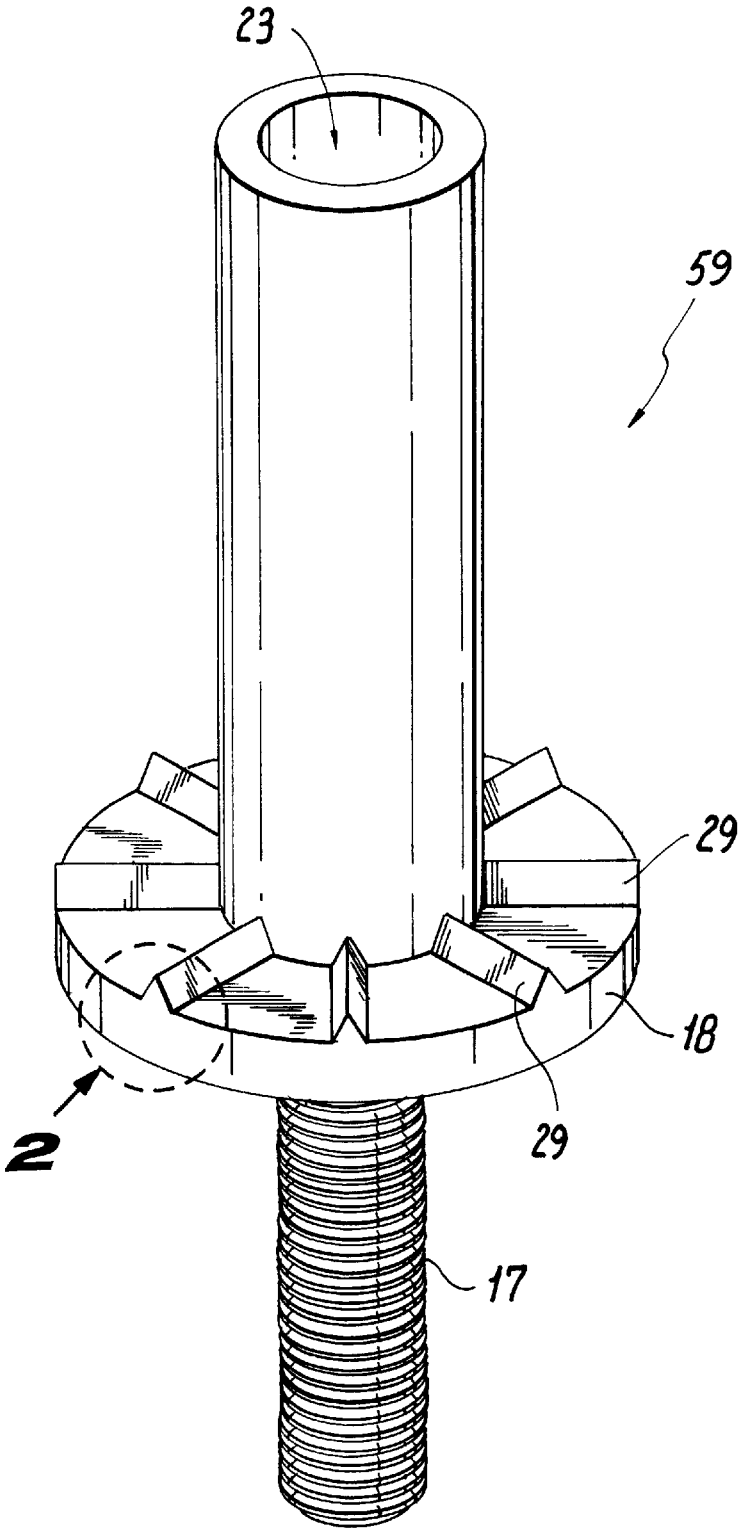
FIG. 1 is a perspective view showing a terminal body according to an embodiment of the invention.

Referring to FIG. 1, an electrically conductive terminal body 59 is an integrally formed element with a plug connection portion 23 at a first end, and a screw portion 17 at a second end. A collar 18 is disposed at an intermediate location. Collar 18 has at least one anti-slip projection 29. Terminal body 59 is formed by cold forging. Plug connection portion 23, collar 18, screw portion 17, and anti-slip projections 29 all have circular shapes about a common axis. That is, plug connection portion 23 has a cylindrical shape, collar 18 has a disk-like shape, and screw portion 17 has a cylindrical-column shape. Anti-slip projections 29 are radially arranged facing upward on a top surface of collar 18.

Anti-slip projections 29 have acutely angular profiles with respect to the top surface of collar 18. Anti-slip projections 29 extend radially at regular intervals from an outer diameter of plug connection portion 23 toward an outer periphery of collar 18.

Figure 2:
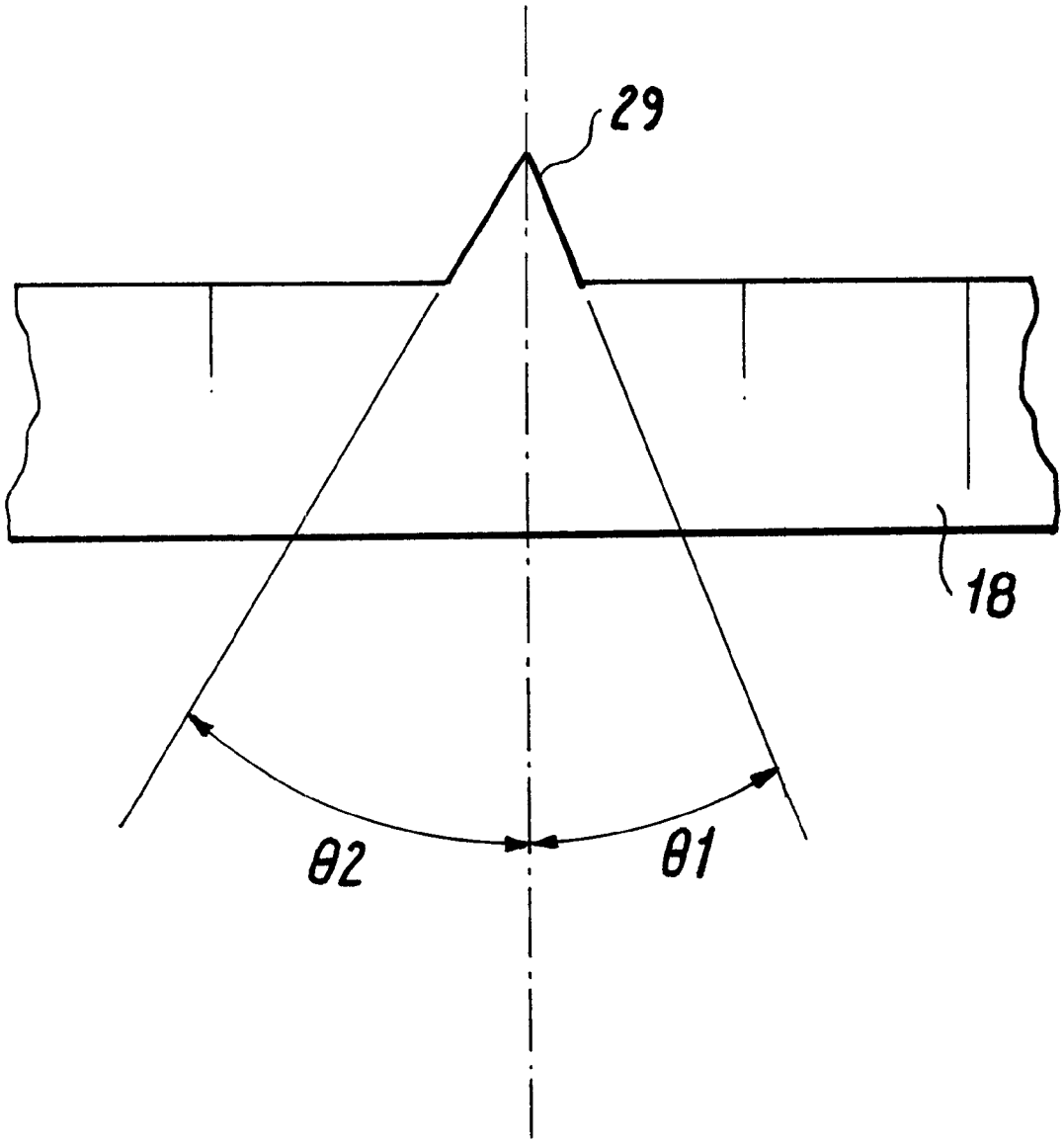
FIG. 2 is an enlarged side view of an anti-slip projection shown in FIG. 1.

Referring now to FIG. 2, each anti-slip projection 29 is shaped asymmetrically relative to the top surface of collar 18. With respect to a perpendicular drawn through the apex of anti-slip projection 29, an angle θ1 shaped on a tightening side of screw portion 17 is smaller than and an angle θ2 shaped on a loosening side of screw portion 17. This formation creates angular asymmetry relative to a perpendicular drawn through the apex of anti-slip projection 29. The asymmetry provides support for loads imposed by tightening of screw portion 17. Additionally, the bottoms of anti-slip projections 29 are spread to strengthen anti-slip projections 29 and limit chipping.

Figure 3A:
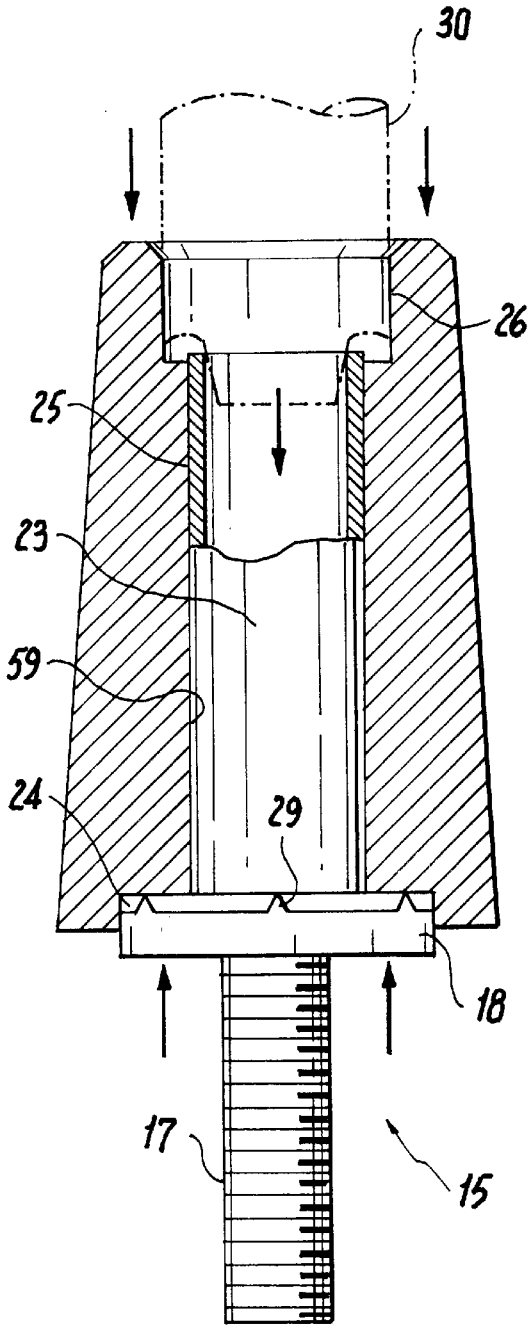
FIG. 3(A) is a sectional view showing the terminal body and the knob fitting together prior to pressing.
Figure 3B:
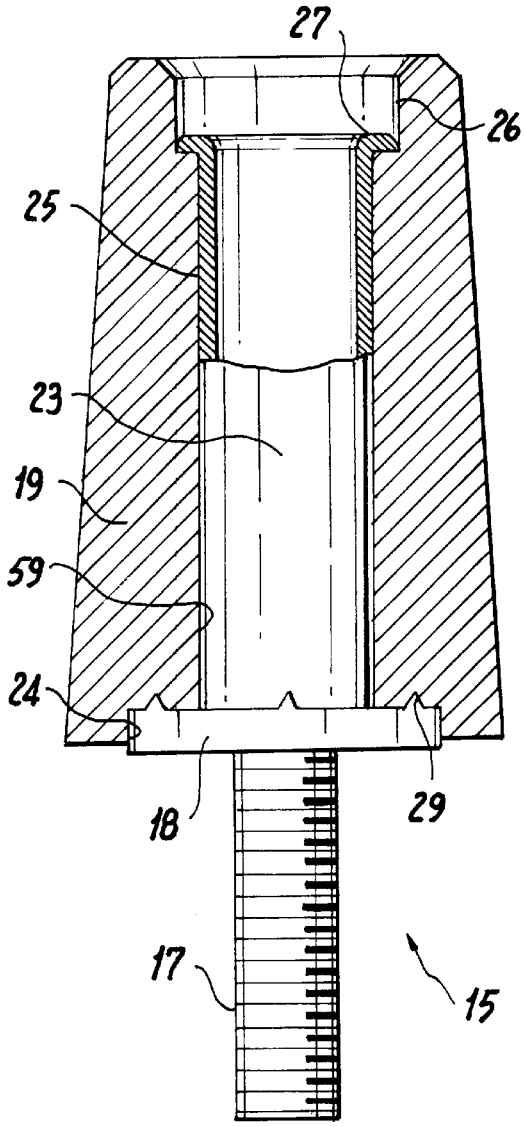
FIG. 3(B) is a sectional view showing the terminal body and the knob pressed together to complete the embodiment.

As additionally shown in FIGS. 3(A) and 3(B), a knob 19 has a fit hole 25, a plug insertion opening 26, and a collar fit-in recess 24. The components of knob 19 are formed in a circular manner so that their respective horizontal cross-sections (relative to the top of the page) have little detail. Particularly, the bottom surface of collar fit-in recess 24 does not require grooves to accept anti-slip projections 29. This simplified formation eliminates the need for pre-positioning during assembly.

As shown in FIG. 3(A), plug connection portion 23 of terminal body 59 fits into fit hole 25 in knob 19. Collar 18 fits into collar fit-in recess 24. Here, insertion occurs without pre-positioning since both collar 18 and collar fit-in recess 24 are free of directional requirements. Insertion pressure between the bottom surface of collar 18 and the top surface of knob 19 engages anti-slip projections 29 in the bottom surface of collar fit-in recess 24.

At the same time, a press-in fitting 30 is inserted in plug insertion opening 26. As press-in fitting 30 contacts the top of plug connection portion 23, pressure deforms outward the top rim of plug connection portion 23 creating a bent portion 27 that engages knob 19 between plug insertion opening 26 and fit hole 25.

As shown in FIG. 3(B), knob 19, made of electrically insulative material, and terminal body 59 are fixed to each other by both the engagement of anti-slip projections 29 into collar fit-in recess 24 and by bent portion 27 engaging knob 19. This engagement prevents terminal body 59 and knob 19 from rotating respective to each other and from losing contact with each other as terminal 15 adjusts.

As shown in FIG. 1, a first embodiment of terminal body 59 has anti-slip projections 29 arranged on the top surface of collar 18. During assembly of terminal 15 and knob 19, anti-slip projections 29 engage collar fit-in recess 24 for fixation.

Figure 4:
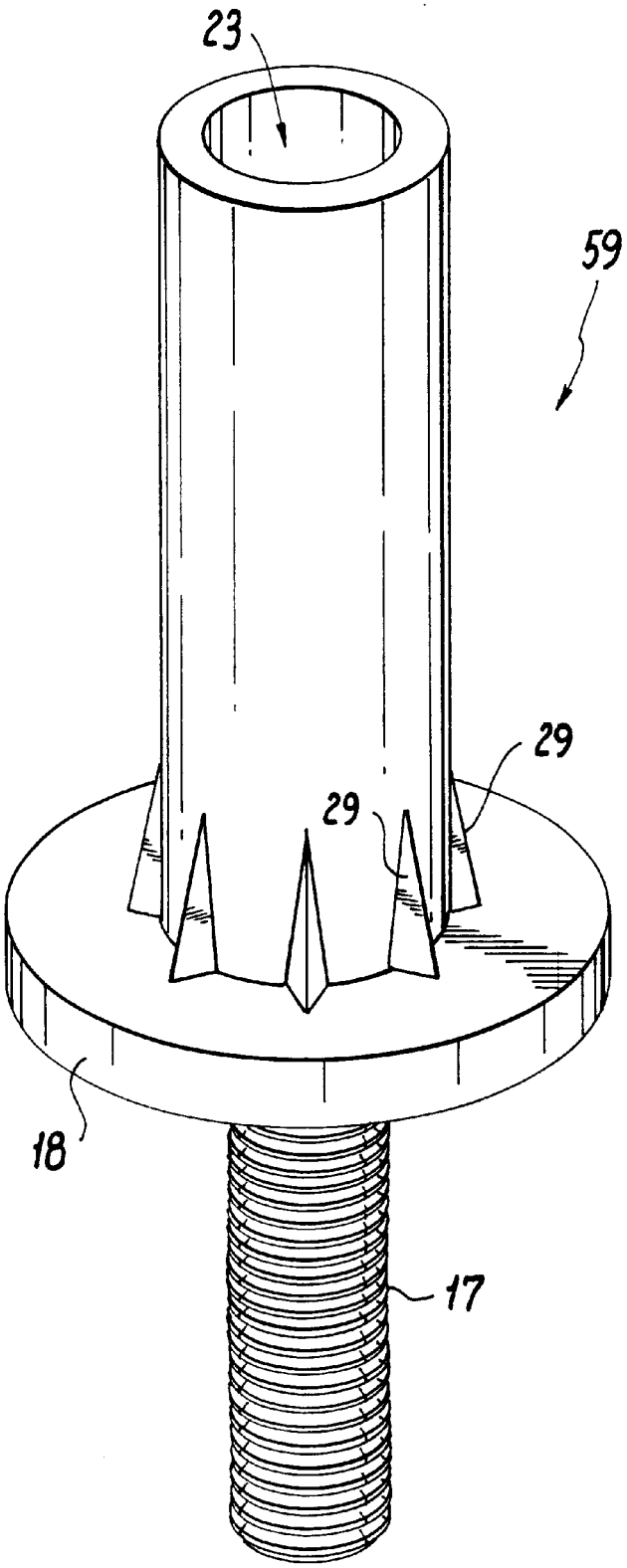
FIG. 4 is a perspective view showing a second embodiment of the present invention.
Figure 5:
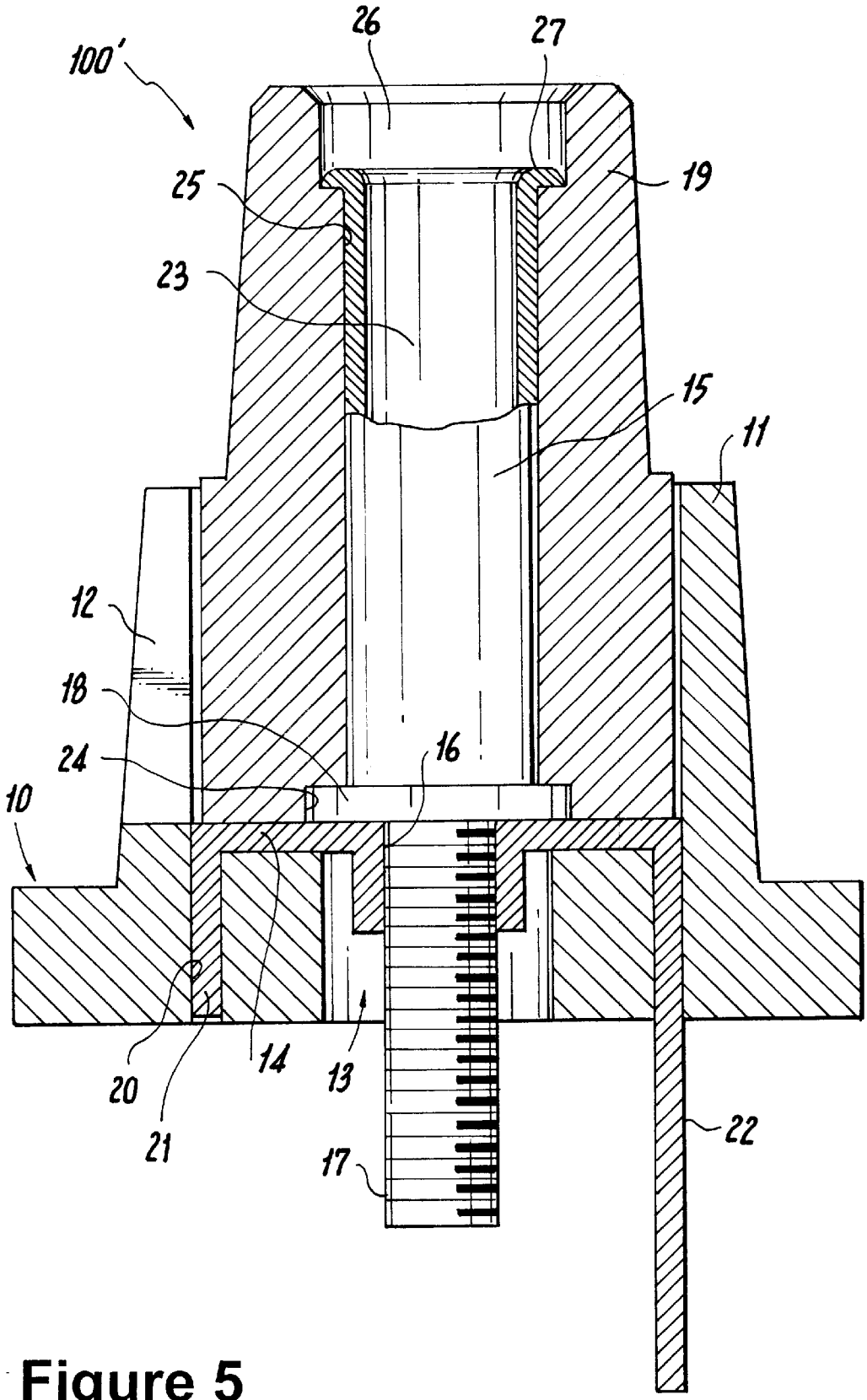
Figure 5 (Prior Art)
FIG. 5 is a sectional view showing a conventional terminal connector.
Figure 6:
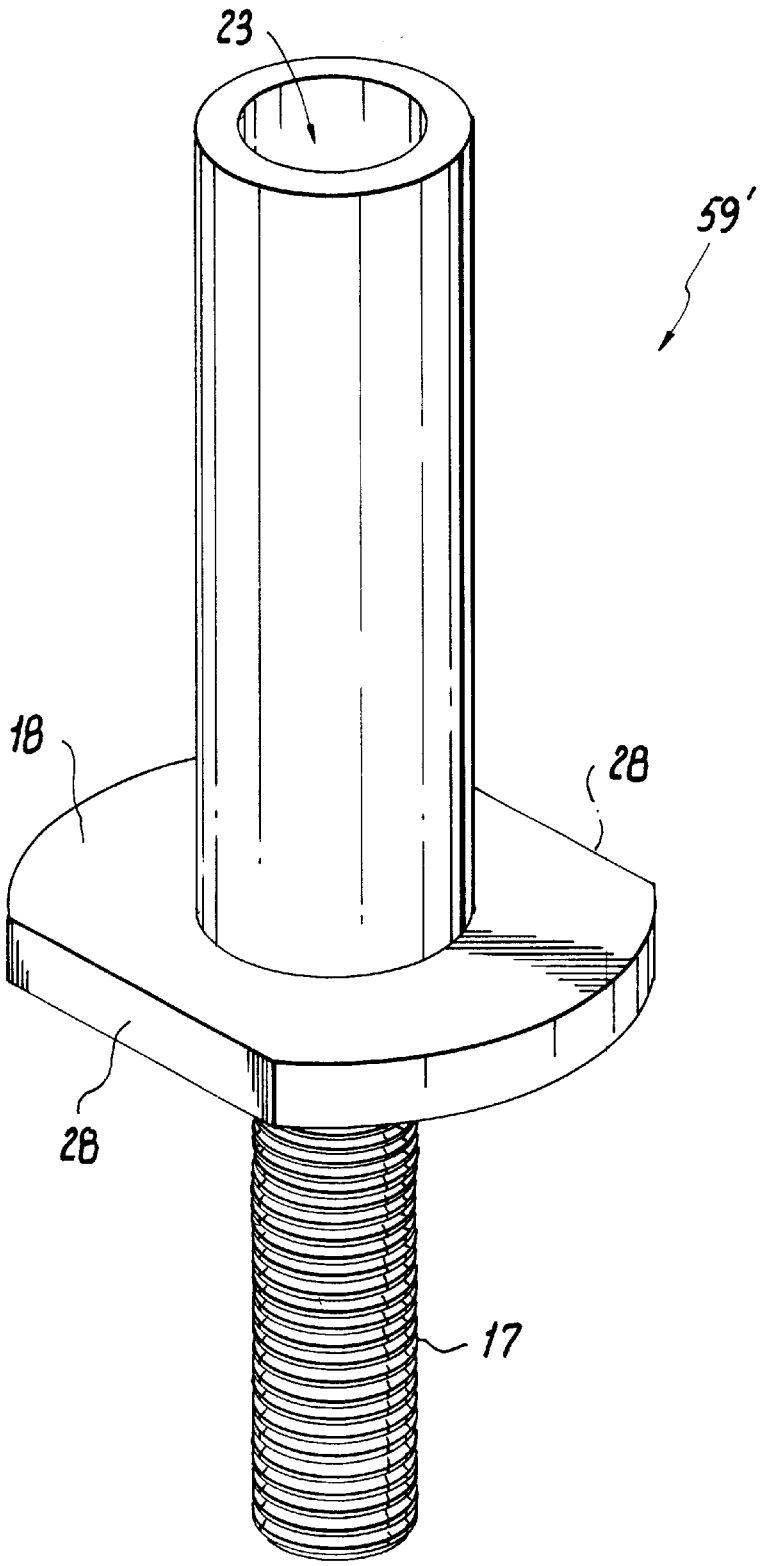
Figure 6 (Prior Art)
FIG. 6 is a perspective view showing a conventional terminal.

Referring now to FIG. 4, a second embodiment of terminal body 59 has anti-slip projections 29 formed as irregular erect pyramids on the border between plug connection portion 23 and collar 18. During assembly of terminal 15 and knob 19, anti-slip projections 29 engage an internal wall of fit hole 25 for fixation instead of collar fit-in recess 24.

Anti-slip projections 29 are not limited to those shapes shown in FIGS. 1 and 4. Anti-slip projections 29 may be of multiple shapes, each serving to fix terminal body 59 to knob 19. For example, corn shapes, polygonal pyramid shapes, and any other shape as long as they can be readily fabricated by a cold forging process.

Additionally, anti-slip projections 29 may be arranged in any other arrangement also readily fabricated by a cold forging process.

The present embodiments offer several positive points.

First, plug connection portion 23, collar 18, screw portion 17, and anti-slip projections 29, constituting terminal body 59, may be fabricated by cold forging alone. Thus, eliminating the need for additional steps required and allowing fabrication at lower costs.

Second, anti-slip projections 29 may be formed in alternative positions unlike conventional flats 28 formed only on collar 18. Thus, terminal body 59 and knob 19 can be integrally and firmly fixed to each other forming terminal 15.

Third, since collar 18 of terminal body 59 has a circular shape, collar fit-in recess 24 in knob 19 may be formed in a circular shape. This eliminates the need for a positioning step during assembly of terminal body 59 with knob 19. Consequently, automatic assembly is more easily and quickly accomplished, thereby improving manufacturing costs.

Having described preferred embodiments of the invention with reference to the accompanying drawings, it is to be understood that the invention is not limited to those precise embodiments, and that various changes and modifications may be affected therein by one skilled in the art without departing from the scope or spirit of the invention as defined in the appended claims.

What is claimed is:

1. A terminal connector comprising:

a circuit board;

a terminal plate attached to said circuit board;

a terminal threadable to said terminal plate and threadably adjustable toward and away from said circuit board;

said terminal having a terminal body and a knob-covering a portion of said terminal body;

said terminal body having a plug connection portion at a first end thereof and a screw portion at a second end thereof;

a collar on said terminal body between said first end and said second end;

said collar having at least one anti-slip projection on a first side of said collar;

said at least one anti-slip projection having a 3D-prismatic shape;

said at least one anti-slip projection having an asymmetrical triangular cross section;

a steeper side of said cross section facing a tightening direction of said terminal connector during a use of said terminal connector;

said knob having a fit hole and a collar fit-in recess; and said plug connection portion engaged in said fit hole and said collar engaged in said collar fit-in recess and said anti-slip projection engaged into said knob.

2. The terminal connector according to claim 1, wherein:

said anti-slip projection having a ridge-like shape profile arranged radially about said collar on said first side of said collar.

3. The terminal connector according to claim 1, wherein:

said anti-slip projection having a pyramid shape profile arranged radially about said plug connection portion and along a long axis of said plug connection portion; and said anti-slip projection between said plug connection portion and said first side of said collar.

4. The terminal connector according to claim 1, wherein:

a rim of said plug connection portion opposite said first side of said collar is bent outward into said fit hole for retaining said knob on said terminal body.

5. A terminal body comprising:

a plug connection portion having an outside diameter;

a rim at a first end of said terminal body;

a screw portion integral with said plug connection portion at a second end of said terminal body;

a collar between said plug connection portion and said screw portion;

said collar having a first face perpendicular to said outside diameter;

at least one integral anti-slip projection adjacent said collar;

said at least one integral anti-slip projection having a 3D prismatic shape;

said at least one integral anti-slip projection having an asymmetrical triangular cross section; and a steeper side of said cross section facing a tightening direction of said terminal body during a use of said terminal body, whereby said at least on anti-slip projection is effective to resist a slipping of said terminal body relative to an external body during said use.

6. A terminal body as in claim 5, wherein:

said anti-slip projection affixed radially on said first face.

7. A terminal body as in claim 5, wherein:

said anti-slip projection is arranged radially and axially about said plug connection portion along said outside diameter.

8. A terminal body as in claim 5, wherein said anti-slip projection is asymmetrical relative to an adjustment direction.

9. A terminal comprising:

a terminal body;

said terminal body including a collar extending radially therefrom;

a generally cylindrical portion of said terminal body extending on a first side of said collar;

a threaded portion of said terminal body extending on a second side of said collar;

said threaded portion permitting threaded attachment of said terminal body to an external element;

a knob press fitted onto said cylindrical portion;

a plurality of anti-slip projections on said terminal body;

said anti-slip projections having a 3D prismatic shape; and said anti-slip projections penetrating said knob when said knob is fitted to said cylindrical portion, thereby permitting application of torque from said knob to said threaded portion.

10. A terminal according to claim 9 wherein:

said plurality of anti-slip projections on said collar each extending from said first side;

at least one of said anti-slip projections having an axis generally radial to said collar;

a cross section of said prismatic shape being an asymmetrical pyramidal cross section, with a first surface of said pyramidal cross section having a steeper slope than a second surface; and said first surface facing in a tightening direction of torque applied to said knob during a tightening of said terminal, thereby preferentially resisting torque applied during tightening of said terminal.

11. A terminal according to claim 9 wherein:

said plurality of anti-slip projections extend from said collar in said first direction on said cylindrical body;

each of said anti-slip projections having a first triangular profile in an axial and a second triangular profile in a radial direction;

said first triangular profile being asymmetric with a first surface angle steeper than a second surface angle; and said first surface angle being disposed in a rotational direction in which torque is applied from said knob to said terminal body during tightening of said terminal.

12. A terminal connector comprising:

a substrate;

a terminal plate attached to said substrate;

a terminal;

a terminal body on said terminal;

a knob on said terminal body;

at least one anti-slip projection on said terminal body;

said at least one anti-slip projection having a 3D prismatic shape;

said at least one anti-slip projection having an asymmetrical triangular cross section;

a steeper side of said cross section facing a tightening direction of said terminal connector;

said terminal body fixedly engaged in said knob;

said at least one anti-slip projection engaging said terminal body with said steeper side of said cross section facing in a tightening direction of said terminal connector; and said terminal threadably connected to said terminal plate.

* * * * *